US010882338B2

(12) United States Patent
Praharaj et al.

(10) Patent No.: US 10,882,338 B2
(45) Date of Patent: Jan. 5, 2021

(54) DRYER FOR DRYING IMAGES ON COATED SUBSTRATES IN AQUEOUS INK PRINTERS

(71) Applicant: Xerox Corporation, Norwalk, CT (US)

(72) Inventors: Seemit Praharaj, Webster, NY (US); Douglas K. Herrmann, Penfield, NY (US); Jason M. LeFevre, Webster, NY (US); Chu-Heng Liu, Penfield, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/710,116

(22) Filed: Dec. 11, 2019

(65) Prior Publication Data

US 2020/0114663 A1 Apr. 16, 2020

Related U.S. Application Data

(62) Division of application No. 15/988,532, filed on May 24, 2018, now Pat. No. 10,596,832.

(51) Int. Cl.

| | |
|---|---|
| ***B41J 11/00*** | (2006.01) |
| ***B41J 2/01*** | (2006.01) |
| ***B41J 13/00*** | (2006.01) |

(52) U.S. Cl.

CPC ..... *B41J 11/002* (2013.01); *B41J 2/01* (2013.01); *B41J 11/0095* (2013.01); *B41J 13/0009* (2013.01)

(58) Field of Classification Search

CPC . B41J 2/01; B41J 11/00; B41J 11/0015; B41J 11/0095; B41J 13/0009

See application file for complete search history.

(56) References Cited

U.S. PATENT DOCUMENTS

| | | | |
|---|---|---|---|
| 4,991,506 A | 2/1991 | Rodi | |
| 6,425,663 B1 | 7/2002 | Eastlund et al. | |
| 6,463,674 B1 | 10/2002 | Meyers et al. | |
| 8,696,106 B1 | 4/2014 | Moorlag et al. | |
| 8,699,921 B2 | 4/2014 | Petermann | |
| 9,440,459 B1 | 9/2016 | Fromm et al. | |
| 2009/0148620 A1* | 6/2009 | Petermann | B41F 23/0466 427/511 |
| 2010/0045720 A1 | 2/2010 | Dietzel et al. | |
| 2016/0249410 A1* | 8/2016 | Lopez Rodriguez | B41J 11/002 |

* cited by examiner

*Primary Examiner* — Jannelle M Lebron

(74) *Attorney, Agent, or Firm* — Maginot, Moore & Beck LLP

(57) ABSTRACT

A dryer for use in an aqueous ink printer adequately dries coated substrates printed with aqueous ink images before discharge of the substrates. The dryer has a housing, a plurality of laser diodes, a current source, a variable electrical resistance network having a plurality of resistors, and a controller. The controller is configured to identify a plurality of ink coverage densities for a plurality of areas in an ink image that passes through the dryer, select and vary an electrical resistance of one or more of the resistors in the variable electrical resistance network using the identified ink coverage densities, and operate the plurality of resistors in the variable electrical resistance network to connect the laser diodes in the dryer selectively to the current source through the plurality of resistors using the identified ink coverage densities and a speed of the substrate through the dryer.

20 Claims, 8 Drawing Sheets

DRYER FOR DRYING IMAGES ON COATED SUBSTRATES IN AQUEOUS INK PRINTERS

PRIORITY CLAIM

This application is a divisional of and claims priority to U.S. patent application Ser. No. 15/988,532, which is entitled "Printer And Dryer For Drying Images On Coated Substrates In Aqueous Ink Printers," which was filed on May 24, 2018, and which issued as U.S. Pat. No. 10,596,832 on Mar. 24, 2020.

TECHNICAL FIELD

This disclosure relates generally to aqueous ink printing systems, and more particularly, to drying systems in such printers.

BACKGROUND

Known aqueous ink printing systems print images on uncoated substrates. Whether an image is printed directly onto a substrate or transferred from a blanket configured about an intermediate transfer member, once the image is on the substrate, the water and other solvents in the ink must be substantially removed to fix the image to the substrate. A dryer is typically positioned after the transfer of the image from the blanket or after the image has been printed on the substrate for removal of the water and solvents. To enable relatively high speed operation of the printer, the dryer heats the substrate and ink to temperatures that typically reach 100° C. Uncoated substrates generally require exposure to the high temperatures generated by the dryer for a relatively brief period of time, such as 500 to 750 msec, for effective removal of the liquids from the surfaces of the substrates.

Coated substrates are desired for aqueous ink images. The coated substrates are typically used for high quality image brochures and magazine covers. These coated substrates, however, exacerbate the challenges involved with removing water from the ink images as an insufficient amount of water and solvents is removed from the ink image by currently known dryers. One approach to addressing the inadequacy of known dryers is to add one or more uniformly drying stages after the first dryer that repeat the uniform drying performed by the first dryer. This approach suffers from a substantial lengthening of the footprint of the printer and an increase in the energy consumed by the printer from the addition of the other uniform drying stages. Also, adding uniform drying stages to an aqueous ink printing system increases the complexity of the system and can impact reliability of the system. Another approach is to increase the temperature generated by a uniform drying stage; however, an upper limit exists for the temperature generated by the uniform drying stage. At some point, the temperature can reach a level that degrades some substrates or the higher temperature of the substrates can result in the output stack of substrates retaining too much heat for comfortable retrieval of the printed documents. Developing drying devices that enable ink images on coated papers to be efficiently processed without significantly increasing the time for processing the images, the footprint of the printer, the complexity of the printing system, or the temperatures to which the substrates are raised would be beneficial.

SUMMARY

A new aqueous ink printing system includes a drying system that enables efficient drying of aqueous ink images without appreciable additional complexity or significant increases in drying temperatures. The printing system includes at least one printhead configured to eject drops of an aqueous ink onto substrates moving past the at least one printhead to form ink images on the substrates, a dryer having a plurality of laser diodes that are configured to be variably controlled, a media transport configured to carry substrates past the at least one printhead and through the dryer to enable the at least one printhead to form ink images on the substrates and to enable the dryer to remove solvents from the ink images, and a controller operatively connected to the dryer and the at least one printhead. The controller is configured to identify an ink coverage density a plurality of areas in an ink image to be printed and to operate the laser diodes in the dryer with reference to the identified ink coverage densities and a speed of the media transport moving substrates through the dryer.

A new dryer enables efficient drying of aqueous ink images without appreciable additional complexity or significant increases in drying temperatures. The dryer includes a housing, a plurality of laser diodes that are configured to be variably controlled, and a controller operatively connected to the plurality of laser diodes. The controller is configured to identify an ink coverage density for each area in a plurality of areas in an ink image to be printed on a substrate and to operate the laser diodes in the dryer with reference to the identified ink coverage densities and a speed of a media transport moving the substrate bearing the ink image past the plurality of laser diodes.

BRIEF DESCRIPTION OF THE DRAWINGS

The foregoing aspects and other features of an aqueous ink printing system that includes a drying system that enables efficient drying of aqueous ink images without appreciable additional complexity or significant increases in drying temperatures are explained in the following description, taken in connection with the accompanying drawings.

DETAILED DESCRIPTION

Figure 1:
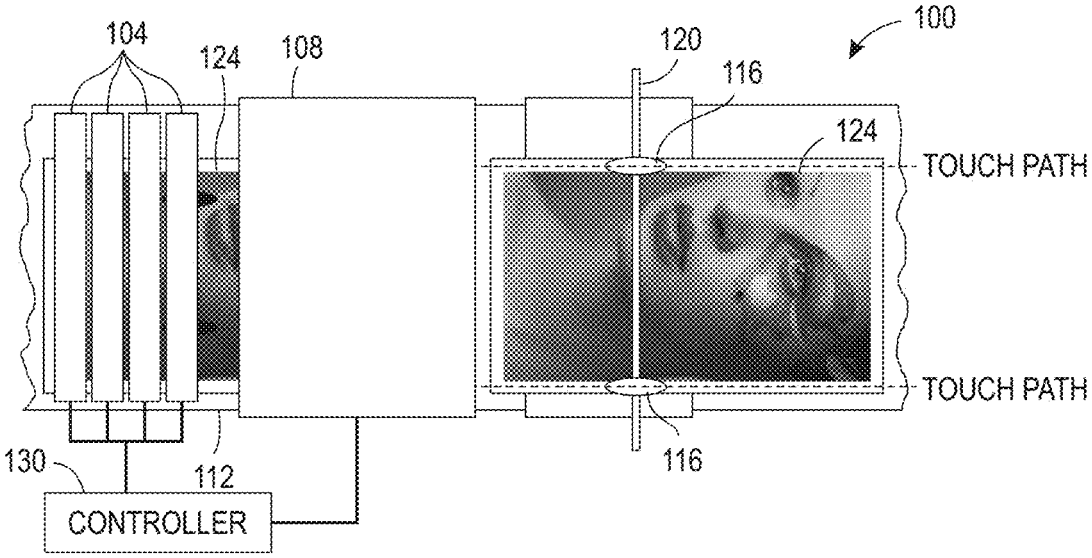
FIG. 1 is a block diagram of an aqueous ink printing system that enables efficient drying of aqueous ink images without appreciable additional complexity or significant increases in drying temperatures.

For a general understanding of the present embodiments, reference is made to the drawings. In the drawings, like reference numerals have been used throughout to designate like elements.

FIG. 1 depicts a block diagram of an aqueous printing system 100 that is configured to print images on coated paper without the energy consumption and elevated substrate temperatures that arise from a series of conventional dryers. The system 100 includes one or more arrays 104 of printheads, a dryer 108, a transport belt 112, a pair of nip rollers 116 mounted about a member 120 that extends in a cross-process direction across the substrates 124 carried by the transport belt 112, and a controller 130. As used in this document, the term "dryer" refers to a configuration of laser diodes that can be variably operated to dry a printed substrate as the substrate passes by the laser diodes. The words "dry" and "drying" as used in this document means using a form of energy to evaporate a liquid or a solvent in an ink image on a substrate. The transport belt 112 is an endless belt wrapped about two or more rollers, one of which is driven by an actuator to rotate the belt about the rollers. Additional structure in the belt is discussed in more detail below. As used in this document, the term "cross-process direction" refers to the direction perpendicular to the direction of substrate movement past the printheads and through the dryer that also lies in the plane of the substrate. The term "process direction" as used in this document refers to the direction of substrate movement past the printheads and through the dryer that also lies in the plane of the substrate.

Figure 3:
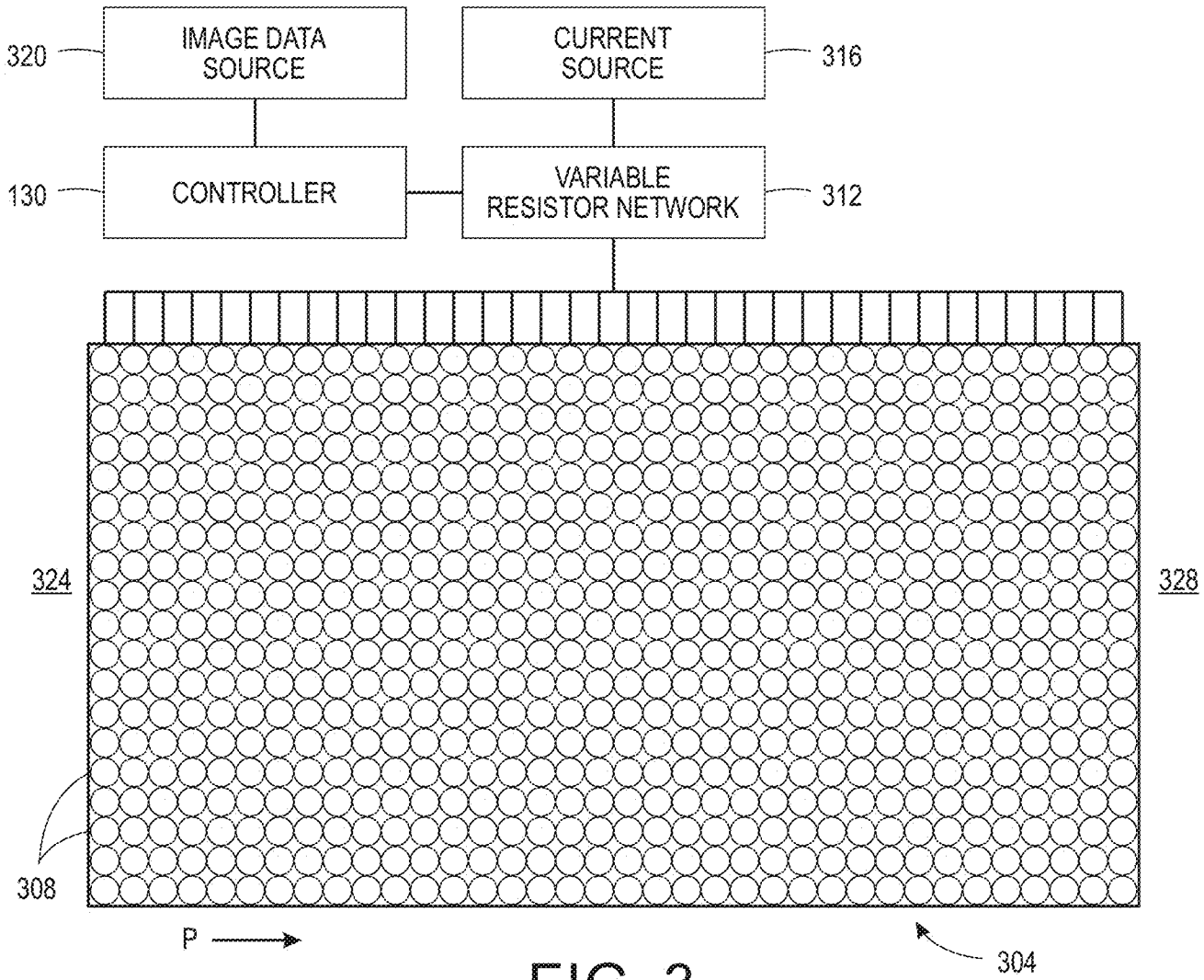
FIG. 3 depicts an array of laser diodes for the dryer of FIG. 1 that varies the intensity of the emitted radiation from each diode with reference to the coverage densities of areas within an ink image to be dried and that tracks an image as it passes by the array.

The printhead arrays 104 are operated by the controller 130 in a known manner to eject drops of aqueous ink onto the substrates passing by them to form ink images on the substrates. The dryer 108 is configured with a plurality of laser diodes 308 that are arranged in an array 304 as shown in FIG. 3. The leading edge 324 of the array 304 in the process direction P is positioned at the entrance of a housing, which is represented by the block for the dryer in FIG. 1, and the trailing edge 328 of the array 304 in the process direction P is positioned at the exit of the dryer housing. Each of the laser diodes 308 is connected through a variable resistance network 312 to a current source 316. The controller 130 is also operatively connected to the variable resistance network 312 and to an image data source 320. The image data source 320 provides the color separations for an ink image to be printed and the data used by the controller 130 to generate the firing signals to operate the ejectors in the printheads of the printhead arrays 104 to eject ink for each pixel in a color separation. Although a single controller 130 is shown in FIG. 1 for operating the dryer 108 and the printhead arrays 104, two or more controllers or other logic units, processors, or the like, can be used to operate the dryer and the printhead arrays separately with the different controllers communicating with one another to synchronize the operations described below.

Figure 2:
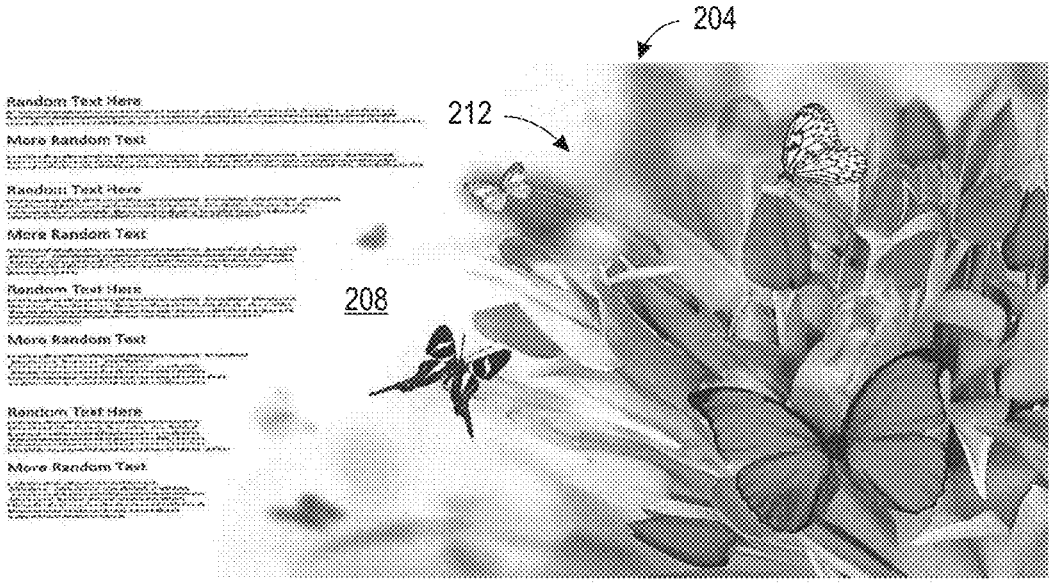
FIG. 2 depicts an ink image having text areas and graphic areas of different coverage densities.

For purposes of discussing the principles of operation of the novel dryer configuration used in the dryer 108 in the printer 100, the array 304 has the same length and width as the ink image shown in FIG. 2. The ink image 204 in FIG. 2 has an area 208 that primarily textual and white space and an area 212 that is graphical. The textual area 208 is shown as a white background printed with black ink characters, although other colors of ink could be used to print the characters and the background could be another color as well. This textual area 208 has a relatively low ink mass per unit area. The graphical area 212 presents a graphic image that is composed of different shades of different colors. Not only does a graphic image require more ink per unit area, even when an image is formed with black ink on a white background, but some of the colors require two or more inks to produce the necessary color or shade of color. Because the graphical area 212 has more ink per unit area, it has more solvent and water than the textual area 208 so it requires more energy to remove the water and other solvents in the ink to stabilize the image than the textual area. A conventional dryer would not distinguish between these areas and have to provide drying energy to the entire ink image based on the highest ink per unit area in the ink image. Uniform application of such a high level of drying energy over the entire area of the ink image is inefficient use of the energy and can produce image quality defects.

Figure 4:
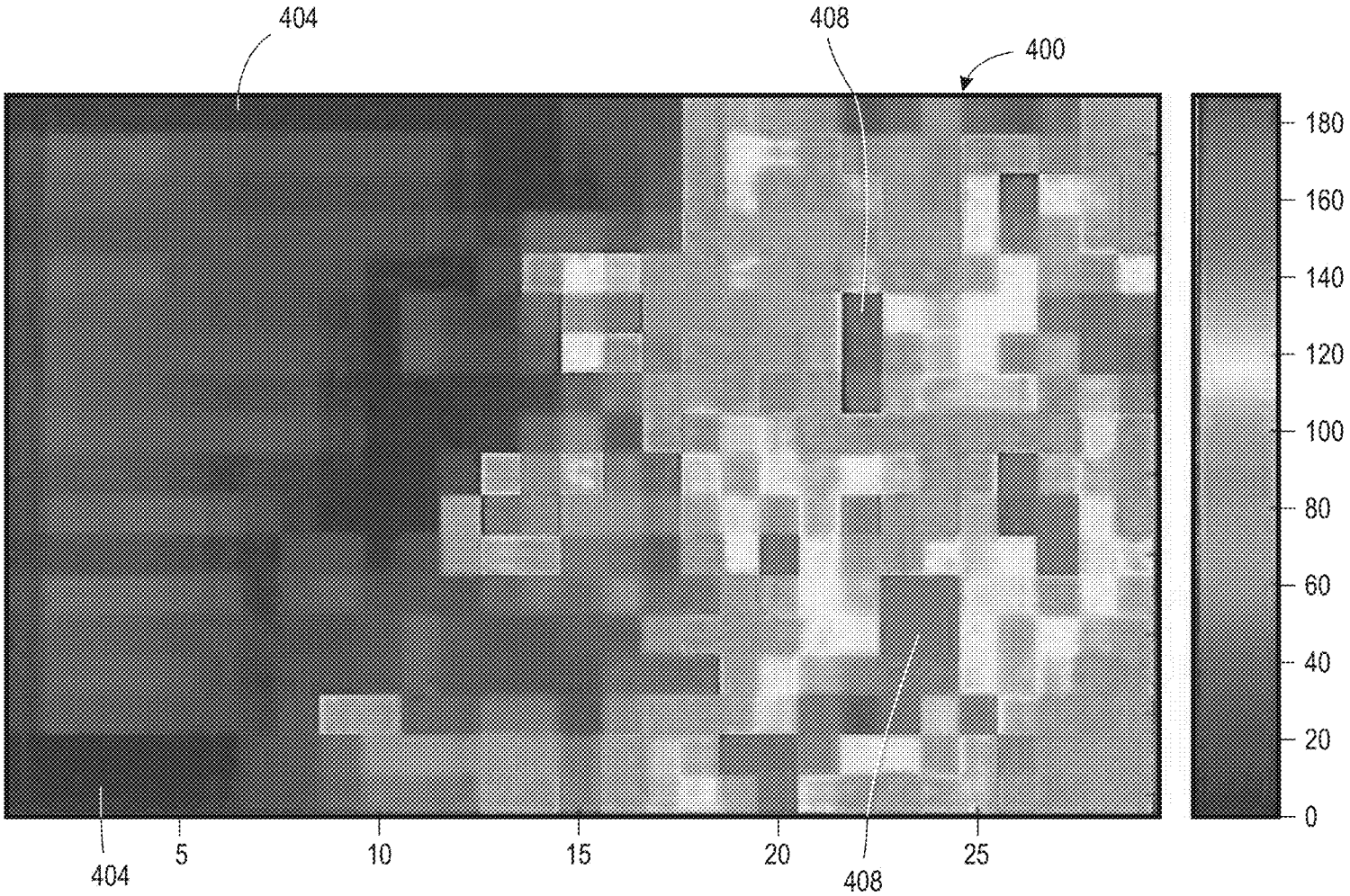
FIG. 4 is an illustration of the operation of the laser diodes in the array of FIG. 3 to dry the ink image shown in FIG. 2.

Again, with reference to FIG. 2 and FIG. 3, the controller 130 identifies areas within the ink image that correspond to different ranges of ink amounts per unit area. These identified image areas and their ink coverage densities are stored in a memory for later use. Controller 130 accesses these data to operate the laser diodes 308 in the dryer 108 as the media bearing the printed image corresponding to these data enters the dryer 108 and passes by the laser diodes in the array. The ink coverage intensities and the speed of the transport bearing the printed image are used by the controller 130 to determine what areas are opposite the various diodes in the array 304. As the different areas pass by the laser diodes 308 in the array 304, the controller 130 sets the value for selected resistors in the variable resistor network 312 and operates switches in the network to connect the corresponding laser diodes 308 in the array 304 to the current source 316 through the resistors having the values set by the controller 130. The amount of current that a laser diode receives from the current source 316 determines the intensity of the radiation emitted by the laser diode. The controller 130 continues to update the resistor values and the switches operated in the network as the image proceeds past the array 304 in the dryer 108. When the ink image is completely under and opposite the laser diode array 304, the controller 130 operates the variable resistor network 312 to operate the laser diodes 308 in the array 304 at the different intensities as shown by the intensity map depicted in FIG. 4. The intensities in the map conform to the shaded bar presented to the right of the intensity map 400 in the figure. For the areas in the image that need no drying because no ink is present, such as the margins of the textual areas 208, the controller does not connect those laser diodes to the current supply. The intensities for these areas correspond to the shading at the lower end of the bar. For areas in the image that have an average amount of ink per unit area within one of the predetermined ranges, the laser diodes are connected to the current supply through a resistor value so the laser diodes are operated with a current that varies from nearly zero percent to over one hundred percent of the power that a laser diode can produce. The areas of the image that require over one hundred percent of the radiation power that a laser diode can produce are areas in which the ink per unit area exceeds the upper end of the highest predetermined range. Such an area corresponds to the areas in which the butterflies and flower petals are presented in FIG. 2. The diodes for these areas need to be operated to produce more than one hundred percent of the power at which the diodes produce radiation to ensure effective drying. These intensities correspond to the shading at the upper end of the bar in FIG. 4 and correspond to the areas 408 in the intensity map 400.

To provide the exposure time needed to dry the most saturated ink per unit area that the printer can produce, the length of the dryer must be determined with reference to the transport speed. First, empirical studies are performed to determine the amount of time required to dry an area having the most saturated ink per unit area at some selected level of power that can be obtained from one of the laser diodes. A range of media types are printed in this manner and transported through a dryer operating at some selected power level at a selected speed. After the media sheets have passed through the dryer they are subjected to a wipe test to assess the susceptibility of the ink image to touch. Once an exposure time for the selected power level has been determined for the worst-case media type and most saturated ink per unit area, the temperature corresponding to this selected power is used with the empirically determined time in the following manner to determine the power rating required for the laser diodes in the array. In this example, the most saturated ink per unit area on the most difficult-to-dry media is dried when exposed to a drying temperature of 140° C. for 1.4 seconds.

The laser diodes 308 in the array 304 can be infrared (IR) laser diodes, microwave radiators, or the like. One IR laser diode that can be used distributes radiation over a 5 mm×5 mm area on a media sheet. Typical ink thickness on the media is approximately 1 μm. The ink volume on an area of an image is: $V_{ink}$=0.005 m*0.005 m*0.000001 m=2.5 E-11 $m^3$. For a typical aqueous ink, the volume of water is approximately 60% water. Therefore, the volume of water in the ink volume is: $V_{water}$=0.6*$V_{ink}$=1.5 E-11 $m^3$. The density of water is 1000 Kg/$m^3$ so the mass of water to be evaporated by a single laser diode is: 1.5 E-11 $m^3$*1000 Kg/$m^3$=1.5 E-8 Kg. The majority of the energy required to dry the ink on the media is based on the latent heat of vaporization of water, which is 2260 KJ/Kg. The energy required to raise the temperature of the water in the ink to 100° C. is miniscule (~200 KJ/Kg) compared to the energy required to provide the latent heat of vaporization of water. This required energy is: $E_{req}$=(1.5 E-8 Kg)*(2260 KJ/Kg)*(1000 J/KJ)=0.033 J and this energy needs to be supplied almost instantaneously. Assuming the time the diode exposes the 5 mm×5 mm area is 10% of the exposure time needed to dry the image, then the time opposite the diode is t=0.1*$t_{residence}$=0.1*2 seconds=0.2 seconds so the minimum power of the IR laser diode required for the array is: $E_{req}$t=0.033 J/0.2 s=0.1695 W or 169.5 mW. Thus, the laser diodes 308 used to populate the array 304 are diodes that can be operated to produce this level of power at a minimum.

To estimate the number of IR laser diodes required for an array, the length and width of the array need to be determined. The length is determined by the product of the media transport speed and the required exposure time to dry the saturated ink image, which in one embodiment is 2 seconds. Thus, length L=0.847 m/s*2 seconds=1.7 m, where 0.847 m/s is the speed at which media sheets are moved through the printer. The width W is at least as wide as the largest image printed by the printer, which in the embodiment being discussed is 8.5 inches or about 0.22 m. The total array area required is determined as: $A_{panel}$=1.7 m*0.22 m=0.374 $m^2$. Assuming a 5 mm×5 mm area of exposure for an individual laser diode as noted previously, the total number of IR laser diodes required is: 0.374 $m^2$/(0.005 m×0.005 m)=14,960 laser diodes. The reader should note that this number is calculated based on a "worst case scenario" of the entire image being ink saturated. This number can be significantly lower if the resolution of the area exposed by a single diode is increased. To increase the exposure area, higher powered laser diodes are required. The following table lists the number of diodes needed, if each diode exposes a larger area, which decreases the exposure resolution:

| IR Laser Diode Exposure Area | IR Laser Diodes Required |
|---|---|
| 1 cm × 1 cm | 3740 |
| 2 cm × 2 cm | 935 |
| 5 cm × 5 cm | 150 |

Figures 5A, 5B, 5C, 5D, 5E:
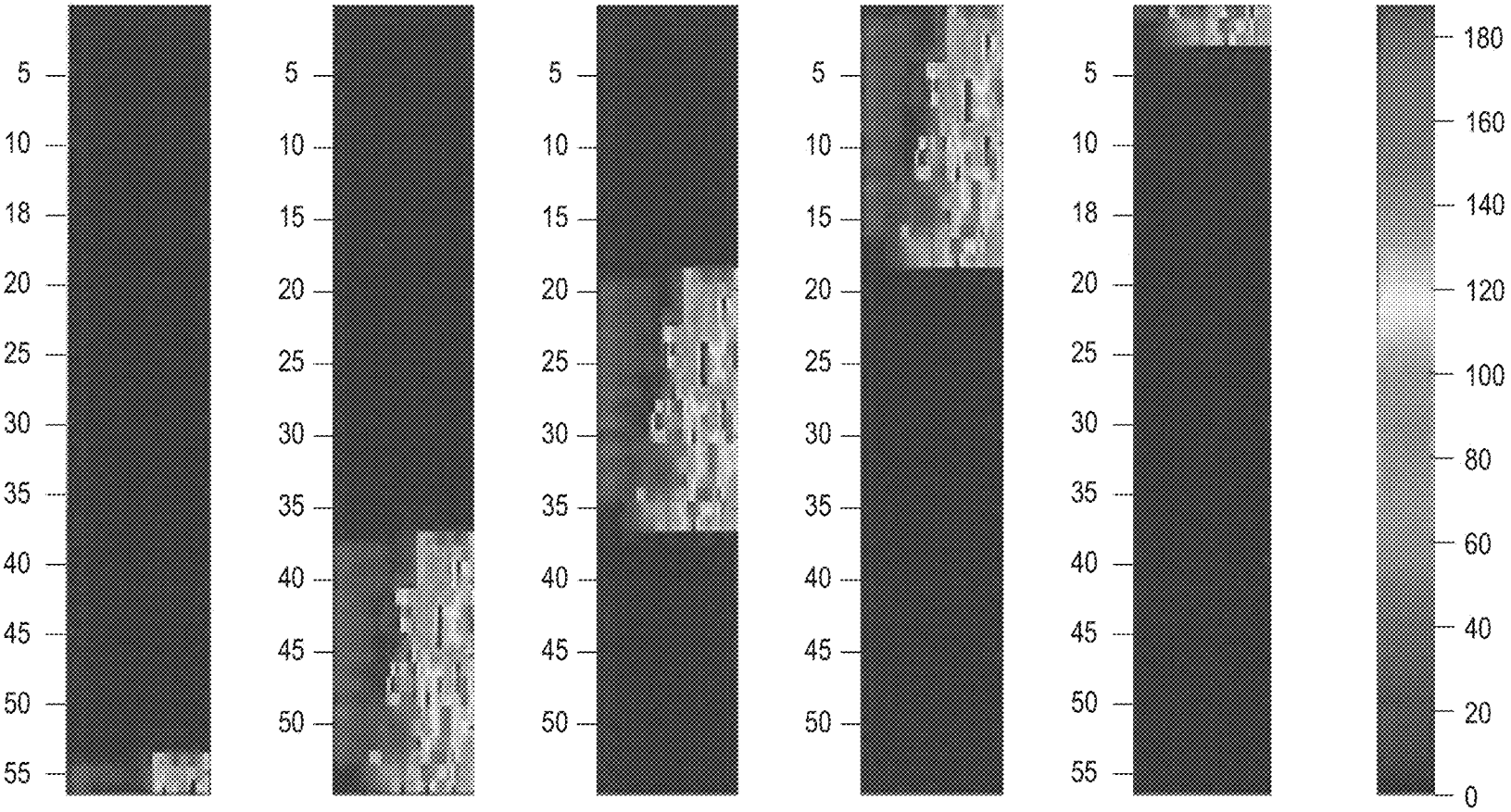
FIG. 5A to 5E illustrates an operation of the laser diodes in an array of laser diodes that has a length that is three times longer than the image shown in FIG. 2 as the ink image passes through the dryer.

The length of the dryer calculated above, 1.7 m, is about six times longer than the length of the image depicted in FIG. 2, which is 11 inches. FIG. 5A to FIG. 5E depicts an image similar to the one shown in FIG. 2 that passes through an array that is a little longer than three times the length of the image and that length is sufficient to dry the ink in the image. In FIG. 5A, the image enters the dryer and the laser diodes at the entrance of the dryer are operated by the controller selectively connecting these laser diodes to the current source through the variable resistor network. The connection of the diodes and the control of the variable resistor network is made with reference to the ink coverage densities for the areas at the leading edge of the image. In FIG. 5B, the entire image has entered the dryer and the controller has selectively operated the laser diodes as the image passes the laser diodes to change the resistance through which the laser diodes are connected to the current source to produce an appropriate radiation intensity that corresponds to the ink amount in the image area opposite the laser diodes. In FIG. 5C, the entire image has traversed another length of the image within the dryer and the controller is operating the laser diodes as the image passes through this second segment of the array to produce the intensities depicted in the intensity map shown in the figure that correspond to the stored ink coverage densities for the areas in the image opposite the laser diodes in the array. In FIG. 5D, the entire image has traversed the third length of the image within the dryer and the controller is selectively operating the laser diodes by updating the resistances through which the laser diodes are connected to the current source as the image passes through the third segment of the array to produce the intensities depicted in the intensity map shown in the figure that correspond to the ink coverage densities stored for the areas in the image. In FIG. 5E, most of the image has exited the dryer and the laser diodes at the dryer exit are operated by the controller selectively connecting these laser diodes to the current source through the variable resistor network.

Figures 6A, 6B, 6C, 6D, 6E:
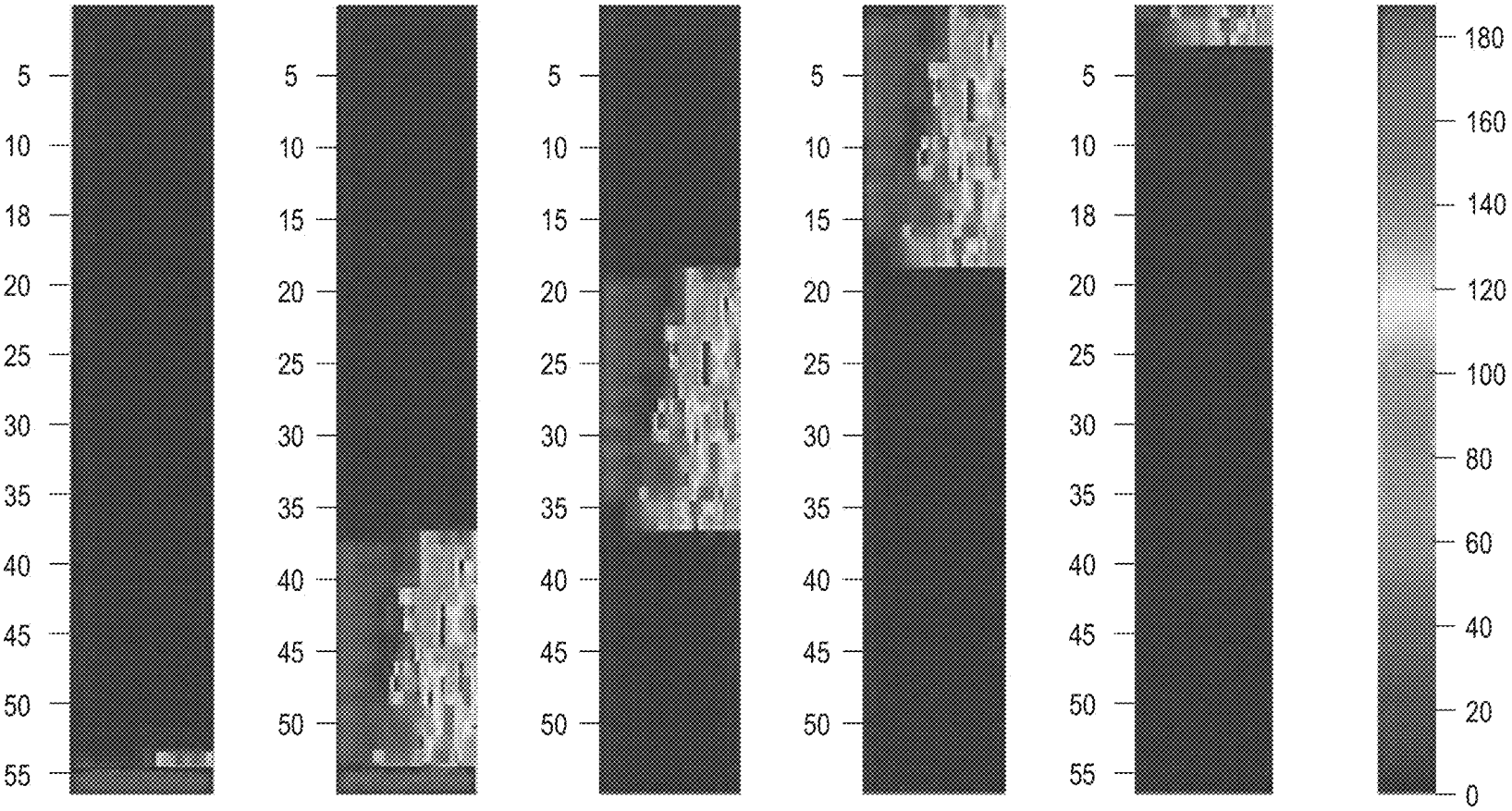
FIG. 6A to FIG. 6E illustrates an alternative operation of the laser diodes in an array of laser diodes that has a length that is three times longer than the image shown in FIG. 2 as the ink image passes through the dryer.
Figures 7A, 7B, 7C, 7D, 7E:
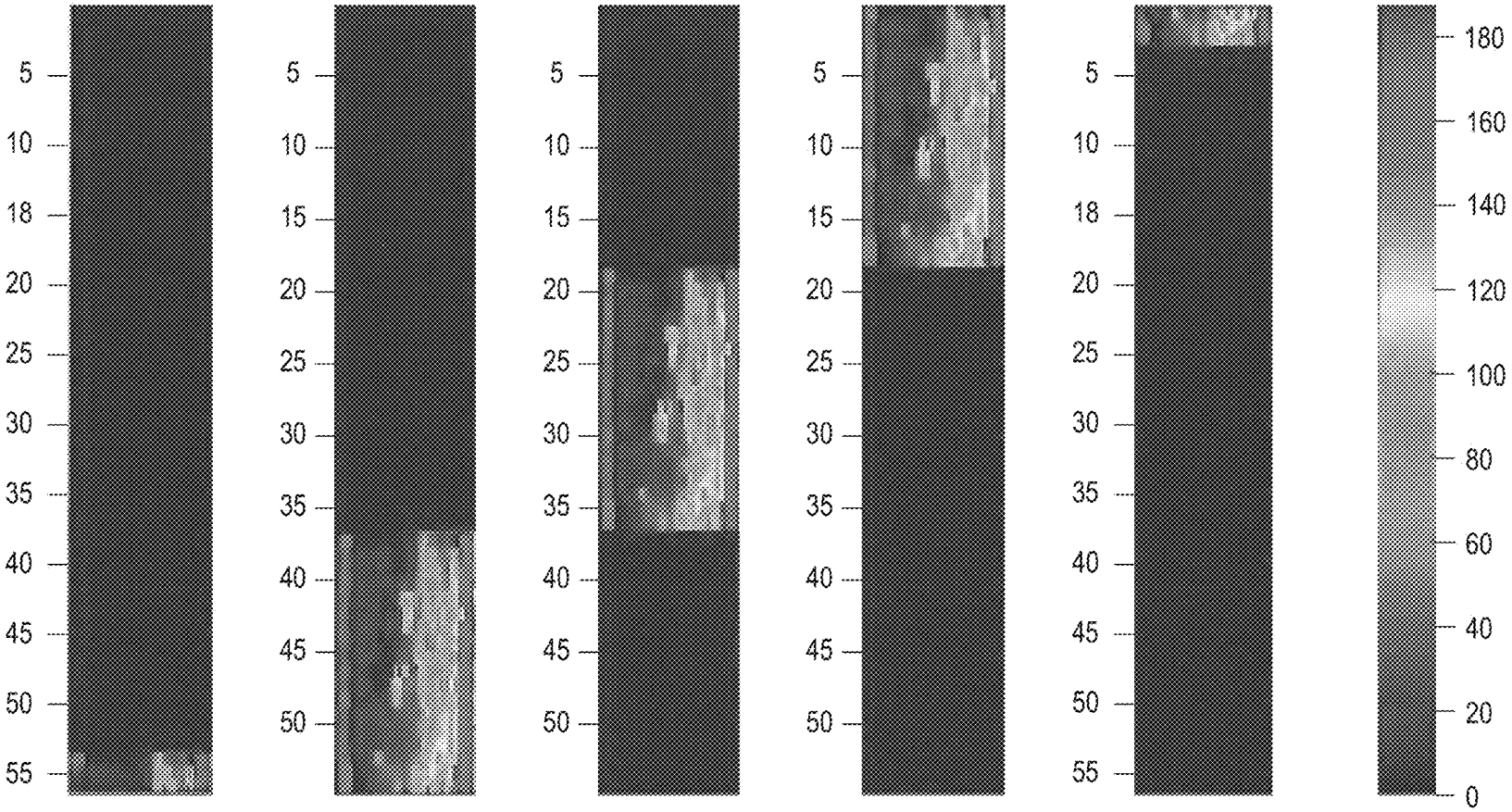
FIG. 7A to FIG. 7E illustrates another alternative operation of the laser diodes in an array of laser diodes that has a length that is three times longer than the image shown in FIG. 2 as the ink image passes through the dryer.

In another embodiment of the dryer, the laser diodes at the leading edge of the array are operated at maximum power as long as a portion of the image is opposite these laser diodes to bring the temperature of the ink up quickly to facilitate the removal of the solvents in the ink. This operation of the leading edge laser diodes is shown in FIG. 6A. As the image progresses through the length of the array, the remainder of the laser diodes are operated as shown in FIG. 6B to FIG. 6E, which corresponds to the operation of the laser diodes in FIG. 5B to FIG. 5E. The elevated temperature achieved at the leading edge of the array shown in FIG. 6A helps ensure the solvents in the ink are adequately dried before the image exits the dryer.

In yet another embodiment of the dryer, the laser diodes are operated selectively at maximum power on the sides of the array extending in the process direction as the image progresses past the array as shown in FIG. 7A to FIG. 7E. The laser diodes inboard from these sides of the array are operated with reference to the identified ink coverage densities for the areas in the image. The operation of these laser diodes is also shown in FIG. 7A to FIG. 7E. The operation of the laser diodes on the longitudinal sides of the array help ensure that the sides of the media are completely dry to touch when the media sheet exits the dryer. This type of array operation is important in printers that position rollers forming driving nips at outboard edges of the dryer exit to propel the media sheets along a reminder of a processing path in the dryer. Such a printer is shown in FIG. 1. This type of array operation addresses what would otherwise be a potential source of image offset in the printer.

Figure 8:
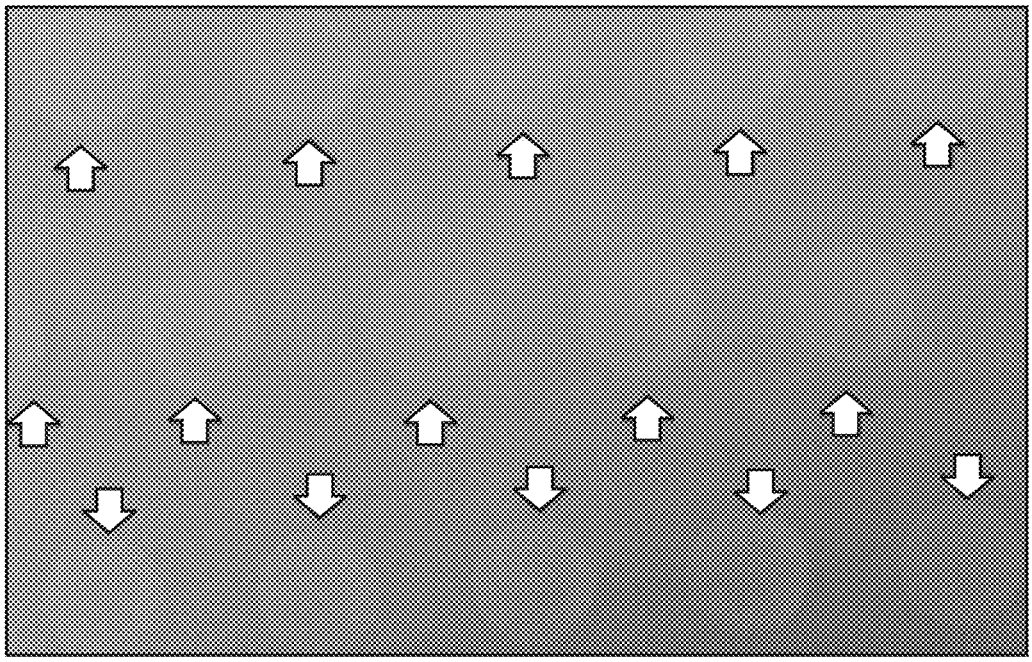
FIG. 8 depicts an artifact produced in drying substrates printed with aqueous ink images on solid transport belts having holes configured to enable air pressure to hold the substrates to the belt.

Another advantage of the dryer shown in FIG. 1 is the elimination of differential drying of the substrates. Differential drying of substrates through previously known dryers is caused by holes in the transport belt that supports the horizontal substrates as they pass through the dryer. The transport belt is positioned between a source of negative air pressure and the substrates carried by the belt so air can be pulled by the negative air pressure through the substrates and the holes in the belt to produce a pressure that helps hold the substrates against the transport belt. The air flow through the portions of the substrates aligned with the holes in the transport belt keeps those portions cooler than the areas that lie against solid areas of the transport belt. This temperature differential produces artifacts in the ink image to which the arrows in FIG. 8 are pointing.

Figure 9:
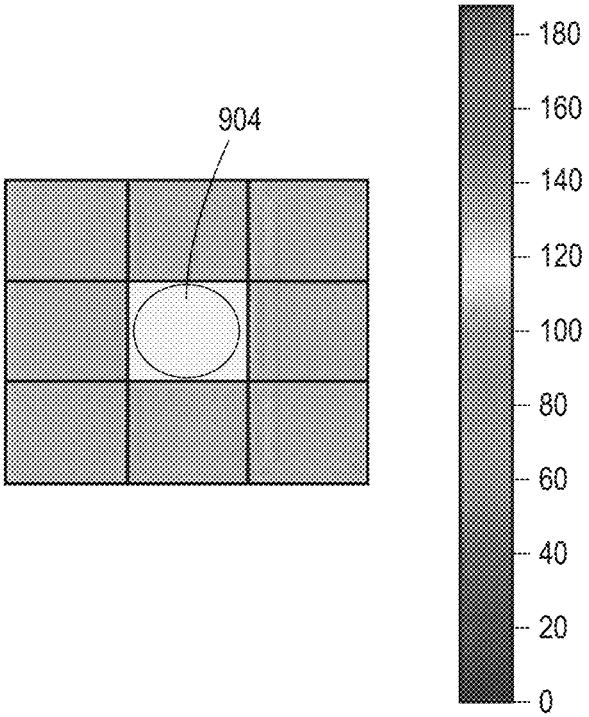
FIG. 9 illustrates a laser radiation intensity map for attenuating or eliminating the artifacts of FIG. 8.

In one embodiment of the transport belt, the belt hole defect has a diameter of 5 mm so the area of a belt hole defect is $n*(2.5\ mm)^2$, which is $19.625\ mm^2$. As noted above, one type of IR laser diode has an exposure area of 5 mm×5 mm, which is a total area of $25\ mm^2$. This exposure area is large enough to cover a belt hole defect. To address the belt hole defects, the controller 130 determines the locations of the belt hole defects in the image as it is being printed by the printhead arrays 104. As the media bearing the image enters the dryer 108, the controller uses the media transport speed to track the movement of the belt hole defects through the dryer. By activating the diodes opposite the belt hole defects at a higher intensity than the laser diodes opposite the surrounding area as the belt hole defects pass the laser diodes, the temperature differential between the belt hole defect areas and the surrounding area can be significantly attenuated or eliminated. The difference in the intensity of laser radiation exposure to reduce the temperature differential at the belt hold defect 904 is illustrated in FIG. 9.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A dryer for an aqueous ink printer comprising:

a housing;

a plurality of laser diodes positioned within the housing;

a current source;

a variable electrical resistance network having a plurality of resistors and a plurality of switches; and a controller operatively connected to the plurality of laser diodes and the variable electrical resistance network, the controller being configured to:

identify a plurality of ink coverage densities for areas of an ink image printed on a substrate before the substrate passes through the dryer;

select and vary an electrical resistance of one or more of the resistors in the variable electrical resistance network using the identified ink coverage densities; and operate the plurality of switches in the variable electrical resistance network to connect the laser diodes in the dryer selectively to the current source through the plurality of resistors using the identified ink coverage densities and a speed of the substrate passing through the dryer to vary an intensity of radiation emitted by the laser diodes as the ink image printed on the substrate moves past the laser diodes in the dryer.

2. The dryer of claim 1 wherein the plurality of laser diodes is arranged in a rectangular array within the housing so the laser diodes emit radiation directly onto the ink image printed on the substrate as the substrate passes through the housing.

3. The dryer of claim 2 wherein the laser diodes are infrared laser diodes.

4. The dryer of claim 2 wherein the laser diodes are microwave diodes.

5. The dryer of claim 2 wherein the rectangular array has a width in a cross-process direction that is greater than a width of a widest image printed on the substrate passing through the housing and the rectangular array has a length that is at least three times a longest image printed on the substrate passing through the housing.

6. The dryer of claim 5, the controller being further configured to:

operate the switches in the variable electrical resistance network to connect the laser diodes at an entrance to the housing to the current source through resistors having a selected electrical resistance that cause the laser diodes at the entrance to the housing to generate a maximum radiation intensity while any portion the ink image printed on the substrate passes the laser diodes at the entrance of the housing.

7. The dryer of claim 5, the controller being further configured to:

operate the switches in the variable electrical resistance network to the laser diodes that extend in a line in a process direction that are also along edges of the rectangular array extending in the process direction for the length of the rectangular array to the current source to generate a maximum radiation intensity as the ink image printed on the substrate passes by the laser diodes along the edges of the rectangular array that extend in the process direction.

8. The dryer of claim 1, the controller being further configured to:

vary the electrical resistance of one of the resistors connecting one of the laser diodes to the current source so the intensity of the radiation emitted by the laser diode changes as the identified ink coverage density for the portion of the ink image printed on the substrate that is opposite the one laser diode changes.

9. The dryer of claim 1, the controller being further configured to:

identify areas corresponding to places where temperature differential defects in the ink image printed on the substrate can arise; and change the electrical resistance of one of the resistors in the variable electrical resistance network connecting one of the laser diodes to the current source to an electrical resistance that increases a current delivered to the one laser diode so the intensity of the radiation emitted by the one laser diode increases when one of the identified places where temperature differential defects in the ink image can arise passes under the one laser diode.

10. A dryer for an aqueous ink printer comprising:

a housing;

a plurality of laser diodes positioned within the housing, the plurality of laser diodes being arranged in a rectangular array within the housing and the rectangular array has a width in a cross-process direction that is greater than a width of a widest image printed on the substrate passing through the housing and the rectangular array has a length that is at least three times a longest image printed on the substrate passing through the housing;

a current source;

a variable electrical resistance network having a plurality of resistors and a plurality of switches; and a controller operatively connected to the plurality of laser diodes and the variable electrical resistance network, the controller being configured to:

identify a plurality of ink coverage densities for areas of an ink image printed on a substrate before the substrate passes through the dryer;

select and vary an electrical resistance of one or more of the resistors in the variable electrical resistance network using the identified ink coverage densities; and operate the plurality of switches in the variable electrical resistance network to connect the laser diodes in the dryer selectively to the current source through the plurality of resistors using the identified ink coverage densities and a speed of the substrate passing through the dryer to vary an intensity of radiation emitted by the laser diodes as the ink image printed on the substrate moves past the laser diodes in the dryer.

11. The dryer of claim 10 wherein the laser diodes are infrared laser diodes.

12. The dryer of claim 10 wherein the laser diodes are microwave diodes.

13. The dryer of claim 10, the controller being further configured to:

vary the electrical resistance of one of the resistors connecting one of the laser diodes to the current source so the intensity of the radiation emitted by the laser diode changes as the identified ink coverage density for the portion of the ink image printed on the substrate that is opposite the one laser diode changes.

14. The dryer of claim 10, the controller being further configured to:

identify areas corresponding to places where temperature differential defects in the ink image printed on the substrate can arise; and change the electrical resistance of one of the resistors in the variable electrical resistance network connecting one of the laser diodes to the current source to an electrical resistance that increases a current delivered to the one laser diode so the intensity of the radiation emitted by the one laser diode increases when one of the identified places where temperature differential defects in the ink image can arise passes under the one laser diode.

15. The dryer of claim 10, the controller being further configured to:

operate the switches in the variable electrical resistance network to connect the laser diodes at an entrance to the housing to the current source through resistors having a selected electrical resistance that cause the laser diodes at the entrance to the housing to generate a maximum radiation intensity while any portion the ink image printed on the substrate passes the laser diodes at the entrance of the housing.

16. The dryer of claim 15, the controller being further configured to:

operate the switches in the variable electrical resistance network to connect the laser diodes that extend in a line in a process direction that are also along edges of the rectangular array extending in the process direction for the length of the rectangular array to the current source to generate a maximum radiation intensity as the ink image printed on the substrate passes by the laser diodes along the edges of the rectangular array that extend in the process direction.

17. The dryer of claim 15, the controller being further configured to:

operate the switches in the variable electrical resistance network to connect the laser diodes that extend in a line in a process direction that are also along edges of the rectangular array extending in the process direction for the length of the rectangular array to the current source to generate a maximum radiation intensity as the ink image printed on the substrate passes by the laser diodes along the edges of the rectangular array that extend in the process direction.

18. A dryer for an aqueous ink printer comprising:

a housing;

a plurality of laser diodes positioned within the housing;

a current source;

a variable electrical resistance network having a plurality of resistors and a plurality of switches; and a controller operatively connected to the plurality of laser diodes and the variable electrical resistance network, the controller being configured to:

identify a plurality of ink coverage densities for areas of an ink image printed on a substrate before the substrate passes through the dryer;

select and vary an electrical resistance of one or more of the resistors in the variable electrical resistance network that connect one or more of the laser diodes to the current source, the selection and variation of the electrical resistance for the one or more resistors being made using the identified ink coverage densities so the intensity of the radiation emitted by the one or more laser diodes changes as the identified ink coverage density for the portion of the ink image printed on the substrate that is opposite the one laser diode changes; and operate the plurality of switches in the variable electrical resistance network to connect the laser diodes in the dryer selectively to the current source through the plurality of resistors using the identified ink coverage densities and a speed of the substrate passing through the dryer to vary an intensity of radiation emitted by the laser diodes as the ink image printed on the substrate moves past the laser diodes in the dryer.

19. The dryer of claim 18, the controller being further configured to:

identify areas corresponding to places where temperature differential defects in the ink image printed on the substrate can arise; and change the electrical resistance of one of the resistors in the variable electrical resistance network connecting one of the laser diodes to the current source to an electrical resistance that increases a current delivered to the one laser diode so the intensity of the radiation emitted by the one laser diode increases when one of the identified places where temperature differential defects in the ink image can arise passes under the one laser diode.

20. The dryer of claim 19, the controller being further configured to:

operate the switches in the variable electrical resistance network to connect the laser diodes at an entrance to the housing to the current source through resistors having a selected electrical resistance that cause the laser diodes at the entrance to the housing to generate a maximum radiation intensity while any portion the ink image printed on the substrate passes the laser diodes at the entrance of the housing.

* * * * *